US006098318A

United States Patent [19]

Diaz

[11] Patent Number: 6,098,318

[45] Date of Patent: Aug. 8, 2000

[54] BOOT FOR A SKATING APPARATUS

[76] Inventor: Oscar Diaz, 1040 Village Pkwy., Coppell, Tex. 75019

[21] Appl. No.: 09/109,313

[22] Filed: Jun. 30, 1998

Related U.S. Application Data

[63] Continuation-in-part of application No. 08/730,346, Oct. 15, 1996, abandoned.

[51] Int. Cl.[7] ..... A43B 23/00; A43B 5/16

[52] U.S. Cl. ..... 36/137; 36/136; 36/115

[58] Field of Search ..... 36/137, 136, 132, 36/115, 139, 2.6, 118.4, 118.3, 118.8, 117.8, 119.1

[56] References Cited

U.S. PATENT DOCUMENTS

| | | | |
|---|---|---|---|
| 4,015,111 | 3/1977 | Spector | 240/2.25 |
| 4,085,528 | 4/1978 | Delery . | |
| 4,363,502 | 12/1982 | Bakerman | 280/816 |
| 4,367,515 | 1/1983 | Beard | 362/103 |
| 4,466,204 | 8/1984 | Wu | 36/132 |
| 4,712,319 | 12/1987 | Goria | 36/137 |
| 4,771,394 | 9/1988 | Cavanagh | 364/561 |
| 4,848,009 | 7/1989 | Rodgers | 36/137 |
| 4,913,437 | 4/1990 | Newcomb et al. | 273/162 R |
| 5,080,359 | 1/1992 | Thill | 273/60 B |
| 5,149,489 | 9/1992 | Crews | 362/32 |
| 5,171,033 | 12/1992 | Olson et al. | 280/11.22 |
| 5,285,586 | 2/1994 | Goldston et al. | 36/137 |
| 5,303,131 | 4/1994 | Wu | 362/103 |
| 5,329,432 | 7/1994 | Bland | 362/103 |
| 5,370,390 | 12/1994 | Swanson | 273/56 |
| 5,394,312 | 2/1995 | Bland | 362/103 |
| 5,396,720 | 3/1995 | Hwang et al. | 36/137 |
| 5,403,000 | 4/1995 | Woosley | 273/1.5 R |
| 5,413,380 | 5/1995 | Fernandez | 280/844 |
| 5,456,478 | 10/1995 | Hsu et al. | 280/11.22 |
| 5,473,518 | 12/1995 | Haber et al. | 362/103 |
| 5,502,903 | 4/1996 | Barker | 36/137 |
| 5,508,899 | 4/1996 | McCormick | 362/103 |

FOREIGN PATENT DOCUMENTS

| | | |
|---|---|---|
| 0534560 | 3/1993 | European Pat. Off. . |

*Primary Examiner*—Ted Kavanaugh
*Attorney, Agent, or Firm*—Baker Botts L.L.P.

[57] ABSTRACT

A boot (10) for a skating apparatus includes a first attachment (12) having a first recess (16). A second attachment (14) has a recess (18) that faces the first recess (16) of the first attachment (12). An illuminating device (20) may be inserted into the first recess (16) and the recess (18) of the second attachment (14) such that it is held in place on the boot (10). The first attachment (12) may also have a second recess (28) to retain a second illuminating device (24). The second illuminating device (24) may run from a heel (21) to a toe (26) of the boot (10) and is held in place by one or more sheaths (22).

13 Claims, 2 Drawing Sheets

BOOT FOR A SKATING APPARATUS

This application is a continuation in part of Ser. No. 08/730,346 filed Oct. 15, 1996 now abandoned.

TECHNICAL FIELD OF THE INVENTION

The present invention relates in general to skating devices such as roller skates and ice skates and more particularly to a boot for a skating apparatus.

BACKGROUND OF THE INVENTION

The popularity of in-line skating and ice skating has grown tremendously over the last few years. With the increase in the numbers of individuals participating in skating, skating occurs at all hours of the day and in a variety of public places. Individuals who are actively skating at night are not readily visible to other members of the public which may lead to unfortunate tragedies. Therefore, it is desirable to enhance the ability to see skaters during hours and locations of limited visibility.

SUMMARY OF THE INVENTION

From the foregoing, it may be appreciated that a need has arisen for a skating apparatus that can be readily visible during active skating situations. In accordance with the present invention, a boot for a skating apparatus is provided that substantially eliminates or reduces disadvantages and problems of conventional skates.

According to an embodiment of the present invention, there is provided a boot for a skating apparatus that includes a first attachment and a second attachment on the heel of the boot. The first attachment has a first recess that faces a recess in the second attachment. A first illuminating device may be inserted into the recesses of the first and second attachment to provide increased visibility to the boot. The first attachment may also have a second recess to retain a second illuminating device. The second illuminating device may run from the heel of the boot to the toe of the boot along the side of the boot. The second illuminating device is retained along the boot by one or more sheaths with apertures therethrough.

The present invention provides various technical advantages over conventional skating devices. For example, one technical advantage is to provide a boot with increased visibility. Another technical advantage is to provide a boot with attachments to retain an illuminating device. Yet another technical advantage is to provide a boot that allows for easy removal and installation of an illuminating device. Other examples are readily ascertainable from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
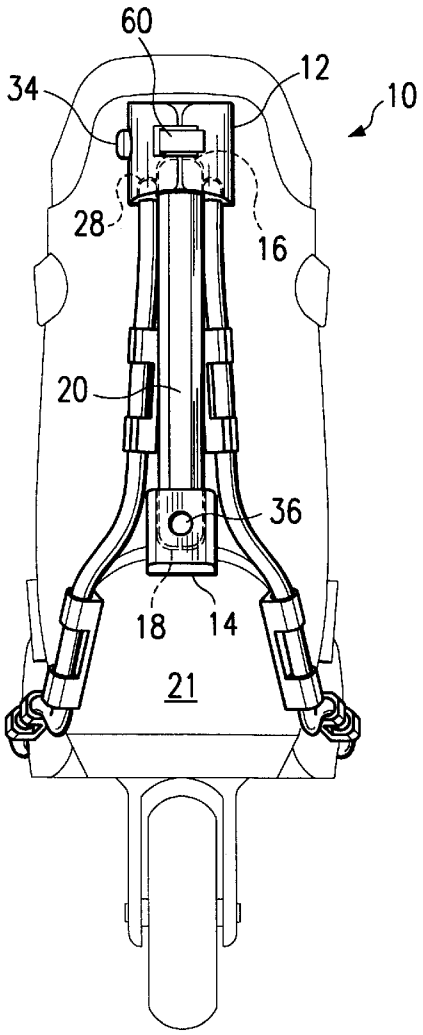
FIG. 1 illustrates a rear view of a boot for a skating apparatus.

FIG. 1 is a rear view of a boot 10 for a skating apparatus. Boot 10 may be for a roller skate, ice skate, or in-line skate and may be constructed as described in U.S. Pat. No. 5,171,033 which is incorporated herein by reference. In addition, boot 10 includes a first attachment 12 and a second attachment 14. First attachment 12 has a first recess 16. Second attachment 14 has a recess 18. First recess 16 of first attachment 12 faces recess 18 of second attachment 14. By having first recess 16 face recess 18, an illuminating device 20 such as a glow stick may be inserted therein and held in place by first attachment 12 and second attachment 14. First attachment 12 and second attachment 14 may be permanently affixed to boot 10 or removably mounted to boot 10 to aid in insertion of illuminating device 20. First attachment 12 and second attachment 14 may also be installed to slide up and down along a heel 21 of boot 10 to further aid in insertion of illuminating device 20 and lock into place to allow for different lengths of illuminating device 20. First attachment 12 and second attachment 14 may have latches that open to allow for insertion of illuminating device 20 and that close to lock illuminating device 20 into place.

Figure 2:
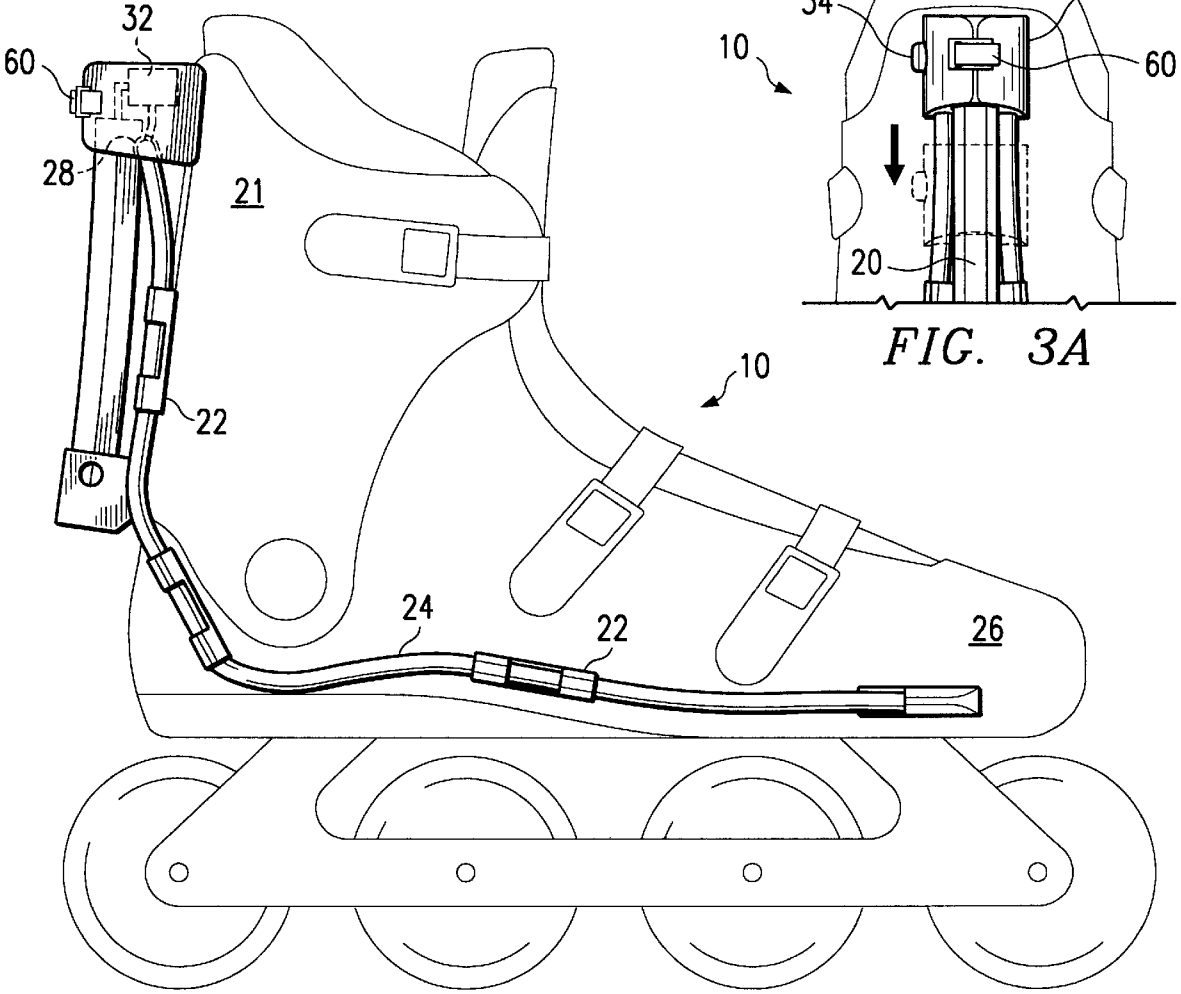
FIG. 2 illustrates a side view of the boot.

FIG. 2 shows boot 10 from a side view perspective. Boot 10 may also include one or more sheaths 22 to retain an illuminating device 24 from heel 21 of boot 10 to a toe 26 of boot 10. First attachment 12 may have a second recess 28 for retaining illuminating device 24. Illuminating device 24 runs along boot 10 through apertures in sheaths 22. Sheaths 22 may be permanently affixed to boot 10 or removably mounted thereon. Sheaths 22 may also have a latch configuration that open to receive illuminating device 24 and close to retain illuminating device 24 to boot 10. Illuminating devices 20 and 24 may provide illumination through chemical interaction of appropriate chemical compounds by powered by a power source installed anywhere in boot 10 such as within first attachment 12. For using an illuminating device 20 or 24 requiring operating power, a power source 32, such as a small conventional battery circuit, may be installed into first attachment 12 to provide the necessary operating power. Other conventional power source techniques may be employed within first attachment 12 as desired for operating an illuminating device requiring external power.

Though shown as attachments to boot 10, first attachment 12, second attachment 14, and sheaths 22 may be permanent receptacles molded into boot 10. Further, illuminating device 24 may be placed along and around boot 10 in sheaths 22 without being retained in first attachment 12.

Figure 3A:
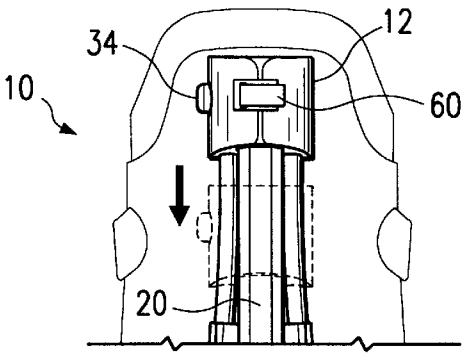
FIGS. 3A and 3B illustrate heel features of the boot.
Figure 3B:
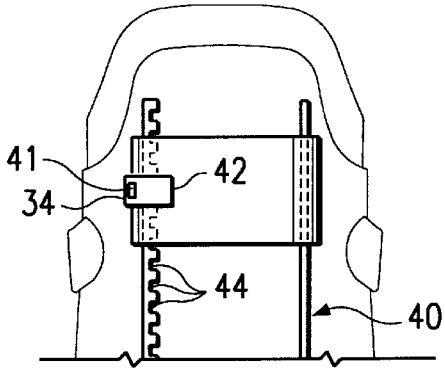

FIGS. 3A and 3B, taken in conjunction with FIGS. 1 and 2, show boot 10 with various features for heel 21. To facilitate different lengths and positioning of illuminating device 20, FIG. 3A shows that first attachment 12 may slide longitudinally along heel 21 of boot 10 through any of various conventional means to include a rail assembly. FIG. 3B shows an example of a rail assembly 40 for boot 10. A locking mechanism 34 may be placed as part of first attachment 12 to release first attachment 12 from rail assembly 40 for longitudinal movement along heel 21 and to secure first attachment 12 anywhere along heel 21. Depressing and holding locking mechanism 34 compresses a spring 41 to free a bar 42 from recesses 44 on rail assembly 40 to allow first attachment 12 to slide up and down within rail assembly 40 as desired along heel 21. Releasing locking mechanism 34 lets bar 42 to re-enter one of the recesses 44 of rail assembly 40 to secure first attachment 12 at the desired point of release on heel 21. Though not shown, second attachement 14 may also have the capability to slide up and down heel 21 as desired.

Figure 4A:
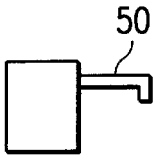
FIGS. 4A–4C illustrate examples of mounting implementations on the boot.
Figure 4B:
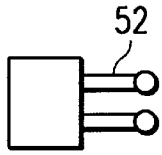
Figure 4C:
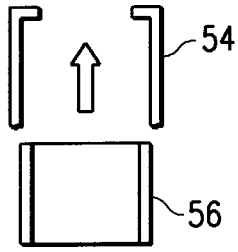

FIGS. 4A–4C show examples of how the attachment devices of first attachment 12, second attachment 14, and sheaths 22 may be removably mounted with boot 10. FIG. 4A shows the use of a hook 50 for the various attachment devices. FIG. 4B shows the use of posts 52 for the various attachment devices. Boot 10 may have apertures or cavities to receive the hook 50 or posts 52 for the attachment devices incorporating these mounting techniques. FIG. 4C shows the use of rails 54 attached to boot 10 to receive flanges 56 on an attachment device such that the attachment device slides into place within rails 54 of boot 10. If rail assembly 40 of FIG. 3B is employed, rail assembly 40 may be constructed such that first attachment 12 may slide completely away from boot 10 upon depressing of locking mechanism 34. Other conventional manners of removably attaching the attachment devices onto boot 10 may also be employed as desired to include a screw 36 as shown.

Figure 5A:
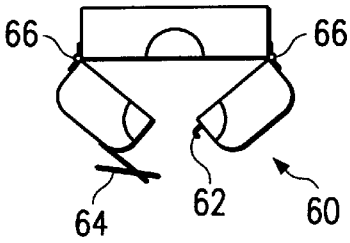
FIGS. 5A and 5B illustrate examples of latching devices for the boot attachments.
Figure 5B:
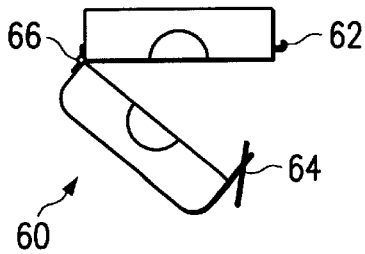

The attachment devices of first attachment 12, second attachment 14, and sheaths 22 may include latches to facilitate insertion and removal of illuminating devices 20 and 24. FIGS. 5A and 5B show examples of latching techniques. FIG. 5A shows an attachment device with a center latch assembly 60. Center latch assembly 30 includes a latch bar 62 and a clasp 64 that can be unclasped to allow two portions of an attachment device to separate through use of a hinge to provide an opening for removal and insertion of illuminating device 22 or 24. The technique shown in FIG. 5B uses a single hinge arrangement to allow for opening and closing of an attachment device. Though a latch system is shown, other conventional techniques may be employed to open and close an attachment device for insertion and removal of an illuminating device to include rails as previously shown or snap-in mechanisms. The use of latch assembly 60 especially provides a technique to facilitate insertion and removal of chemical interactive type illuminating devices in order to easily discard an old illuminating device which no longer illuminates and insert a new fully illuminating illuminating device.

Thus, it is apparent that there has been provided, in accordance with the present invention, a boot for a skating apparatus that satisfies the advantages set forth above. Although the present invention has been described in detail, it should be understood that various changes, substitutions, and alterations readily apparent to one skilled in the art may be made herein without departing from the spirit and scope of the present invention as defined by the following claims.

What is claimed is:

1. A boot for a skating apparatus, comprising:

a first attachment affixed to an upper heel portion of the boot, the first attachment having a first recess;

a second attachment affixed to a lower heel portion of the boot, the second attachment having a first recess that faces the first recess of the first attachment, the first recess of the first attachment facing the first recess of the second attachment, the first and second recess operable to retain an illuminated device, wherein the first and second attachments are removably mounted to the boot.

2. The boot of claim 1, wherein the first and second attachments have longitudinal movement along the heel of the boot to allow for different lengths of the illuminated device.

3. The boot of claim 2, wherein the first and second attachments have locking mechanisms to prevent the longitudinal movement.

4. The boot of claim 1, further comprising:

an illuminated device held in place by the first recess of the first attachment and the first recess of the second attachment, the illuminated device containing a chemical mixture to provide luminescence.

5. The boot of claim 1, further comprising:

an illuminated device held in place by the first recess of the first attachment and the first recess of the second attachment;

a power source to provide illuminating power to the illuminated device.

6. The boot of claim 5, wherein the power source is within the first attachment.

7. A boot for a skating apparatus, comprising:

a first attachment affixed to an upper heel portion of the boot, the first attachment having a first recess;

a second attachment affixed to a lower heel portion of the boot, the second attachment having a recess that faces the first recess of the first attachment, the first and second recess operable to retain an illuminating device, wherein the first and second attachments have latches that open to receive the illuminating device and that close to hold the illuminating device into place.

8. A boot for a skating apparatus, comprising:

a first attachment affixed to an upper heel portion of the boot, the first attachment having a first recess;

a second attachment affixed to a lower heel portion of the boot, the second attachment having a first recess that faces the first recess of the first attachment, the first recess of the first attachment facing the first recess of the second attachment, the first and second recess operable to retain an illuminated device;

one or more sheaths along a side of the boot, each sheath having an aperture to allow an illuminated device to extend from the first attachment to a toe of the boot, the first attachment having a second recess to secure the illuminated device, the second recess of the first attachment facing a same direction as the first recess of the first attachment.

9. The boot of claim 8, wherein the sheaths are removably mounted to the boot.

10. The boot of claim 8, wherein the sheaths have a latch that opens to receive the illuminated device and that close to retain the illuminated device to the boot.

11. The boot of claim 8, further comprising:

an illuminated device held in place by the second recess of the first attachment and the sheaths, the illuminated device containing a chemical mixture to provide luminescence.

12. The boot of claim 8, further comprising:

an illuminated device held in place by the first recess of the first attachment and the sheaths;

a power source to provide illuminating power to the illuminated device.

13. The boot of claim 12, wherein the power source is within the first attachment.

* * * * *